United States Patent [19]

Barcik et al.

[11] 3,934,102

[45] Jan. 20, 1976

[54] AUTOMOTIVE VEHICLE IGNITION LOCKING AND HOOD LATCHING APPARATUS

[75] Inventors: Charles P. Barcik, Westchester; Joseph J. Gagliardo, Chicago, both of Ill.

[73] Assignee: Auto-Sentry Co., Chicago, Ill.

[22] Filed: Feb. 18, 1975

[21] Appl. No.: 550,469

[52] U.S. Cl. ..... 200/44

[51] Int. Cl.[2] ..... H01H 27/00

[58] Field of Search..... 200/44, 42 R; 307/10 R, 307/10 AT; 180/114; 340/64

[56] References Cited

UNITED STATES PATENTS 3,766,341 10/1973 Guenther et al..... 200/44

*Primary Examiner*—Herman J. Hohauser

*Attorney, Agent, or Firm*—Charles B. Cannon

[57] ABSTRACT

An automotive vehicle ignition locking and hood latching apparatus which is an improvement over the apparatus disclosed in U.S. Pat. No. 3,766,341 granted Oct. 16, 1973 on "Locking Device" in the names of Kenneth L. Guenther and Charles P. Barcik. The invention includes a key-controlled locking device for controlling the operation of the electrical ignition system of an automotive vehicle together with a hood latching device under the control of the key controlled locking device for latching the hood of the vehicle in closed position when the key-controlled ignition locking device is in locked position and for automatically unlatching the hood latching device when the key-controlled ignition locking device is in unlocked position. The switch means which is embodied in the apparatus and which is under control of the key-controlled locking device is designed and constructed to overcome a difficulty which was sometimes experienced in the use of the apparatus disclosed in the above-mentioned patent, namely, burning out of a coil spring which was part of the switch means and the electrical circuit in the apparatus of the prior art patent referred to above.

2 Claims, 5 Drawing Figures

AUTOMOTIVE VEHICLE IGNITION LOCKING AND HOOD LATCHING APPARATUS

THE PRIOR ART

The prior art is exemplified by U.S. Pat. No. 3,766,341 granted Oct. 16, 1973 on "Locking Device" in the names of Kenneth L. Guenther and Charles P. Barcik. In the apparatus disclosed in the above-mentioned patent, an electrically conductive compression spring 65 is arranged in a central passage 54-56-61-63 in the body of the device between an eyelet 57 and the enlarged inner end of a pin 62 and the electrically conductive compression spring 65 is a part of the switch means and of the electrical circuit embodied in the apparatus and when the key-controlled cylinder or tumbler 30 is in its rearwardly, or "unlocked" position, as in FIG. 2, the electrically-conductive compression spring 65 does not contact both the eyelet 57 and the enlarged end or head of the pin 62. However, when the keycontrolled cylinder or tumbler 30 is moved forwardly into "locking" position, as in FIG. 1, the electrically conductive compression spring 65 is urged by the pin 62 into electrical contact with the eyelet 57 and thereby closes an electrical circuit from the eyelet 57 by way of electrical conductors 58 and 59 which lead, respectively, from the primary winding of the ignition coil in the primary circuit of the ignition system of the vehicle and to the breaker points 60 in the primary circuit of the ignition system of the vehicle so as to render the ignition system of the vehicle operative.

However, while the apparatus disclosed in U.S. Pat. No. 3,766,341 is, in general, quite satisfactory, it has been found that when it is used with high energy electrical ignition systems of present day automotive vehicles the electrically conductive compression spring 65 may heat up and burn out as the high energy electrical current flows therethrough in the use of the device or apparatus, thereby rendering the ignition system of the patent inoperative. The present invention is designed and intended to overcome the difficulty sometimes experienced in the use of the prior art apparatus of U.S. Pat. No. 3,766,341 while, at the same time, retaining the advantages inherent in the device of the aforesaid patent.

OBJECTS OF THE INVENTION

An object of the invention is to provide a new and improved automotive vehicle ignition locking and hood latching apparatus.

A further object of the invention is to provide a new and improved automotive vehicle ignition locking and hood latching apparatus which is an improvement upon the apparatus which is disclosed in U.S. Pat. No. 3,766,341 granted Oct. 16, 1973 on "Locking Device" in the names of Kenneth L. Guenther and Charles P. Barcik.

An additional object of the present invention is to provide a new and improved automotive vehicle ignition locking and hood latching apparatus which, in use, with present day high energy automotive vehicle ignition systems, overcomes the difficulty sometimes experienced in the use of the apparatus disclosed in the aforesaid U.S. Pat. No. 3,766,341, as discussed above, under the heading "The Prior Art" while, at the same time, retaining the advantages inherent in the use of the apparatus of the aforesaid patent.

Other objects will appear hereinafter.

DESCRIPTION OF FIGURES IN THE DRAWINGS

DETAILED DESCRIPTION OF THE APPARATUS SHOWN IN THE DRAWINGS

Figure 1:
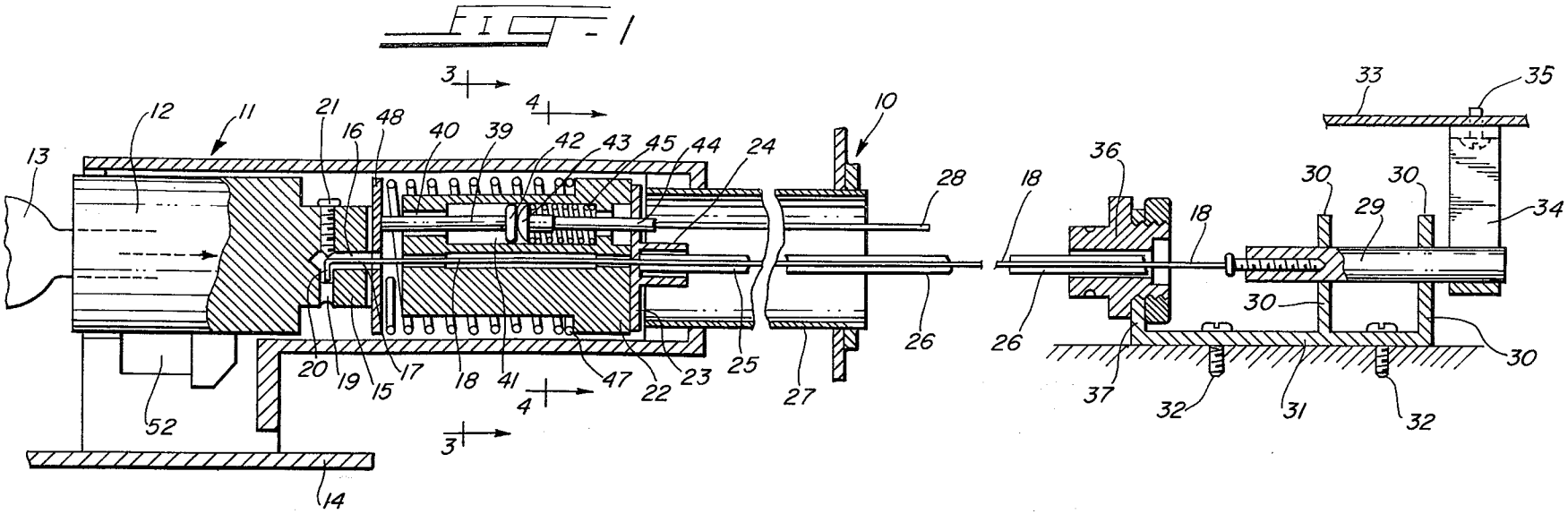
FIG. 1 is an enlarged central longitudinal sectional view of an apparatus embodying the present invention and showing the parts thereof in locked and latched position.

A preferred embodiment of the invention is illustrated in the drawings, wherein it is generally indicated at 10, and comprises a generally cylindrical housing 11 in one end portion of which (left hand end portion, FIGS. 1 and 2) a key-controlled lock cylinder 12 is mounted and is adapted to be controlled by a key 13 which manipulates the locking tumblers as 52. The housing 11 is adapted to be attached to the frame 14 of a motor vehicle, as is well understood in the art.

The key-controlled lock cylinder 12 has a reduced diameter cylindrical inner end section 15 which has an axial passage 16 formed therein for the reception of one end portion 17 of a flexible hood latch control member in the form of a steel wire 18. The passage 16 has a transverse portion 19 for the reception of a hook-shaped end portion 20 of the flexible hood latch control member or steel wire 18 which is held in position by the key-controlled cylinder 12 by means of a fastening element in the form of a rivet 21. (FIGS. 1 and 2)

A generally cylindrical body 22 of electrically insulating or non-conductive material is slidably mounted in the inner or forward end portion of the housing 11 and a retainer member 23 is mounted in the housing 11 and has a reduced diameter end portion 24 in which one end portion 25 of a flexible metal sheath 26 for the flexible hood latch control member or wire 18 is mounted; a flexible protective cable 27 encloses the flexible hood latch control member or wire 18, the protective sheath 26, and a single electrically conductive wire 18, which will be described hereinafter.

A hood latch member or pin 29 is attached to the forward or inner end portion of the flexible hood latch control member or wire 18 and the hood latch member or pin 29 is reciprocably or slidably mounted in a pair of spaced parallel arms 30 of a bracket 31 which is fixedly attached, as by fastening elements 32, to a part 33 of the frame of the motor vehicle below the hood 33 thereof. A retainer hood latch bracket 34 is attached, as at 35, to the inner surface of the hood 33 and depends therefrom, and the hood latch member or pin 29 is movable, by the latch control member or wire 18, into and out of latching engagement with the hood latch bracket 34; it being noted that the hood latch control member or wire 18 is slidably mounted in and projects through a first axially extending passage 53 in the central body 22 (FIGS. 1, 2, 3 and 4).

Figure 2:
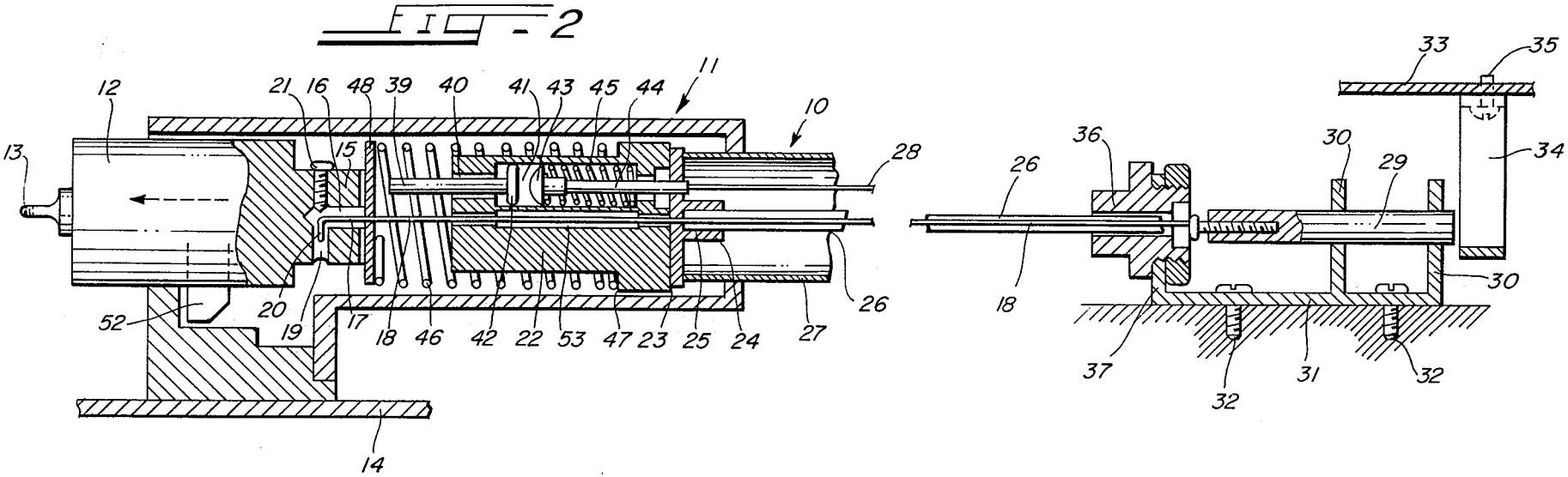
FIG. 2 is an enlarged central longitudinal sectional view of the apparatus shown in FIG. 1 but showing the parts of the apparatus in retracted or unlocked and unlatched position.

The outer or forward end portion of the protective metal sheath 26, and of the hood latch control wire or member enclosed thereby, projects into and is slidably mounted in a mounting unit 36 which is attached to an upright arm 37 of the bracket 31 (FIGS. 1 and 2).

The body of a contact pin member 39 is slidably mounted in a reduced diameter extension 40 of a second axially extending passage 41 which is formed in the central insulating body 22. The contact pin member 39 has a contact head 42 thereon at its inner end and the contact head 42 is slidably mounted in the passage 41 (FIGS. 1 and 2). The contact head 42 of the contact member or pin 39, is adapted to engage a contact head 43 which is fastened to an inner end portion of the electrically conductive wire 28, which has a body of insulating material 44 thereon and a compression spring 45 is mounted in the passage 41 and surrounds the insulating body 44 of the electrically conductive wire 28.

Figure 3:
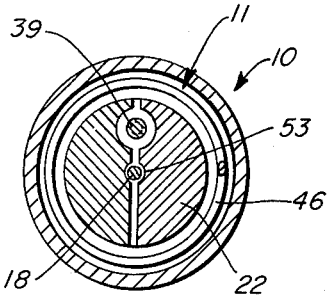
FIG. 3 is a transverse sectional view on line 3—3 in FIG. 1.
Figure 4:
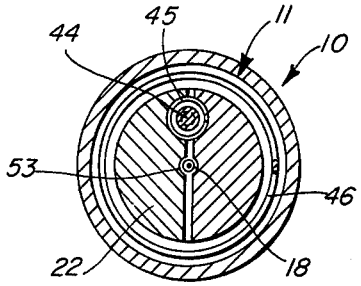
FIG. 4 is a transverse sectional view on line 4—4 in FIG. 1.

A compression spring 46 is mounted in the housing 11 and one end coil thereof abuts an annular shoulder 47 which is formed in the body 22 of the insulating materials and the other end coil of the compression spring 46 abuts a retainer washer 48 which is mounted in the housing 11 between the compression coil 46 and the reduced diameter inner end portion 15 of the key-controlled lock cylinder 12 (FIGS. 2 and 3).

Figure 5:
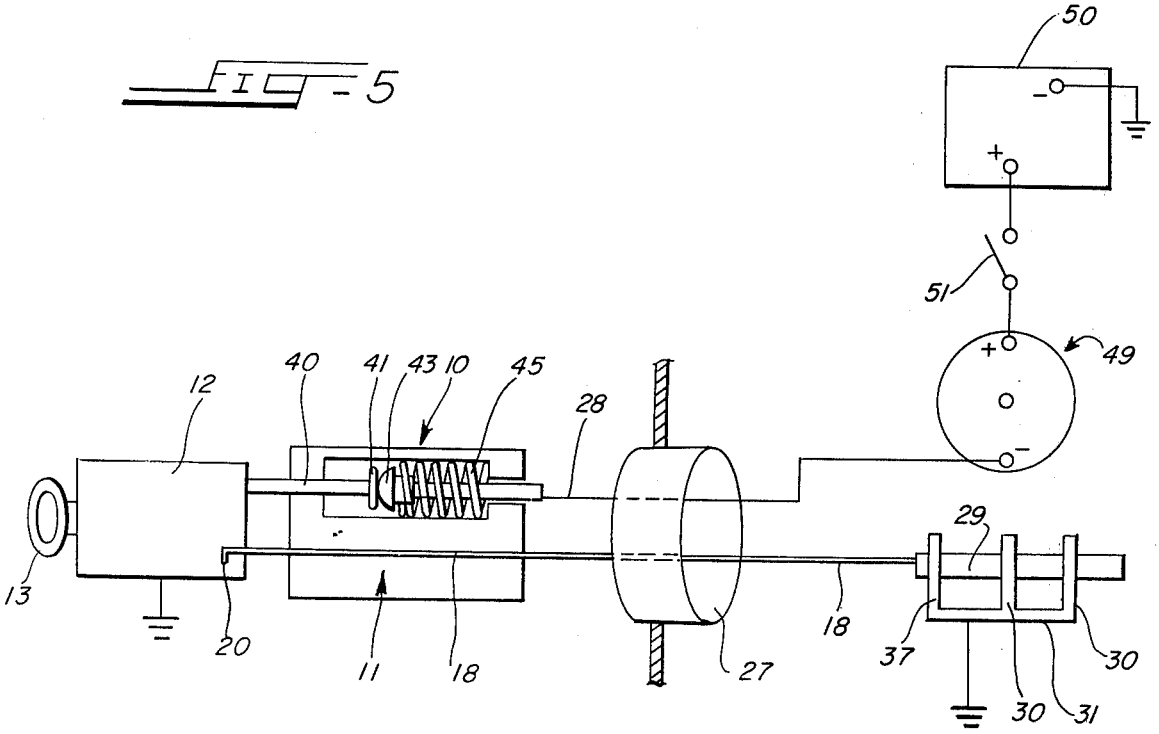
FIG. 5 is a schematic view of the invention as installed in an automotive vehicle.

As shown in FIG. 5, the electrically conductive wire 28 leads to an instrumentality, such as the distributor 49, in the electrical ignition system of the automotive vehicle which includes other conventional components such as a power source, as 50, and an ignition switch as 51.

Operation of the Automotive Vehicle Ignition Locking and Hood Latching Apparatus Shown in FIGS. 1 to 5, Inclusive, of the Drawings In the use of the invention, as illustrated in FIGS. 1 to 5, inclusive, of the drawings, when in unlocked and unlatched and retracted position, the parts are disposed as in FIG. 3, and the head 42 of the contact member or pin 39 is disposed out of electrical contacting engagement with the contact head 43 on the electrically conductive wire 28 so that the electrical circuit (FIG. 5) to the distributor 49 is open or broken, and the latch member or pin 39 on the latch control member or wire 18 is retracted our of latching engagement with the hood latch bracket 34, as in FIG. 2. At this time the key-controlled lock cylinder 12 and the lock tumbler 52 embodied therein are disposed as in FIG. 2 and into which position they are urged by the compression coil spring 46 and the coil springs 45 and 46 are disposed in their expanded positions, as in FIG. 3, with the coil spring 45 engaging the contact head 43 on the inner end portion of the electrically conductive wire 28 and urging the contact head 43 toward the contact head 42 on the contact pin member 39.

However, when the key-controlled lock cylinder 12 is manually pushed inwardly and the key 13 manipulated into inwardly extended and locked position in the housing 11, as in FIG. 1, the latch control member or wall 18 is slidably moved in the central passage 53 in the central body 22 by the reduced diameter inner end portion 15 of the key-controlled lock cylinder 12, into position to project the latch member or pin 39 thereon outwardly into latching engagement with the latching bracket 34 on the hood 33, thereby latching the hood 33 in closed position, as in FIG. 1. The axially inward movement of the key-controlled lock cylinder 12 causes the reduced diameter inner end portion 15 thereof to engage the retaining washer 48 which, in turn, engages and compresses the compression coil spring 46 while, at the same time, engaging and causing the contact pin 39 to move axially inwardly in the axially extending passage 41 and thereby causing the contact head 42 thereon to engage the contact head 43 on the electrically conductive wire 28, thus compressing the coil spring 45 and completing the electrical circuit to the distributor 49 in the primary circuit of the ignition system of the automotive vehicle.

It will be noted, however, that when the contact head 42 on the contact member or pin 39 engages the contact head 43 on the electrically conductive wire 28 the current in the electrical circuit which is thus completed to the distributor 49 does not flow through the compression coil spring 45, which is insulated from the electrically conductive wire 28 by the insulating body 44 on the electrically conductive wire 28. Hence the compression coil spring 45 does not form a part of the electrical circuit in the ignition system of the automotive vehicle and does not heat up or burn out as sometimes happens in the case of the compression coil spring 65 in the apparatus disclosed in U.S. Pat. No. 3,766,341 due to the fact, as pointed out above, that in the apparatus of the aforesaid patent the compression coil spring 65 forms a part of the electrical ignition system of the vehicle and the electrical current in the circuit flows therethrough.

When the key 13 is manipulated in the lock cylinder 12 the parts of the ignition locking system are returned to unlocked position, as in FIG. 2, by the expansion of the compression coil springs 46 and 45 and the hood latch control member or wire 18 and the hood latching member 29 thereon are at the same time returned to unlatched position as in FIG. 2.

It will thus be seen from the foregoing description, considered in conjunction with the drawings, that the present invention provides a new and improved automotive vehicle ignition locking and hood latching apparatus having the desirable advantages and characteristics and accomplishing its intended objects including those hereinbefore pointed out and others which are inherent in the invention.

We claim:

1. A combination automotive vehicle ignition system locking and hood latching apparatus comprising:

a. a generally cylindrical housing adapted to be mounted on the frame of an automotive vehicle and having
   1. an axially outer end portion;
b. a key-controlled lock cylinder slidably mounted in the said axially outer end portion of the said housing and having
   1. a reduced diameter axially inner end portion;
c. a central body slidably mounted in the said housing axially inwardly of the said key-controlled lock cylinder; and having therein
   1. a first axially extending passage;
d. a hood latch control member slidably mounted in the said first axially extending passage in the said central body and having
   1. an inner end portion attached to the said reduced diameter axially inner end portion of the said key-controlled lock cylinder, and having
   2. an outer end portion extending axially outwardly of the said housing;
e. a hood latching member carried by the said outer end portion of the said hood latch control member and adapted to latchingly engage a hood latching member mounted on the inner surface of the hood of the said automotive vehicle when the said hood latch control member and the said hood latching member carried thereby are in outwardly extended position;

f. a second axially extending passage in the said central body and having slidably mounted therein
   1. an electrically conductive member including
      a. an inner end portion having thereon
      b. a first electrically conductive contact head;

g. the said electrically conductive wire member having
   1. an outer end portion to be electrically connected to an instrumentality in the ignition system of the said automotive vehicle, and having
   2. an inner end portion projecting into the said housing and into the said second axially extending passage in the said central body, and having thereon
   3. a body of electrically insulating material;

h. a second contact head on the said inner end portion of the said electrically conductive wire and slidably mounted in the said second axially extending passage in the said central body;

i. a first coil spring in the said housing normally urging the said key-controlled lock cylinder axially outwardly of the said housing and into open or unlocked position and normally urging the said hood latch control member and the said hood latching member carried thereby into unlatched position;

j. a generally annular retainer member in the said housing between the said reduced diameter inner end portion of the said key-controlled lock cylinder and the said first coil spring and adapted to engage the said first coil spring and the said first contact member when the said key-controlled lock member is manually moved axially inwardly in the said housing;

k. a second coil spring in the said second axially extending passage in the said central body and surrounding the said inner end portion of the said electrically conductive wire and normally urging the said second contact head on the said inner end portion of the said electrically conductive wire into electrical contacting engagement with the said first contact head on the said electrically conductive member.

2. A combination automotive vehicle ignition system locking and hood latching device as defined in claim 1 in which a. the said second coil spring has
   1. an axially inner end coil portion which engages the said second contact head on the said electrically conductive wire and in which b. the body of the said second coil spring is disposed out of electrical contacting engagement with the said inner end portion of the said electrically conductive wire so that electrical current flowing through the said electrically conductive member and through the said electrically conductive wire member and through the contact heads thereon does not flow through the said second coil spring.

* * * * *